US006986430B2

(12) United States Patent
Oren

(10) Patent No.: US 6,986,430 B2
(45) Date of Patent: Jan. 17, 2006

(54) SYSTEM FOR HOLDING AND ORGANIZING ARTICLES

(76) Inventor: Meir Oren, 20 Shivtey Israel St., Ramat Hasharon (IL)

( * ) Notice: Subject to any disclaimer, the term of this patent is extended or adjusted under 35 U.S.C. 154(b) by 0 days.

(21) Appl. No.: 10/385,486

(22) Filed: Mar. 12, 2003

(65) Prior Publication Data

US 2004/0178313 A1 Sep. 16, 2004

(51) Int. Cl.
*A47F 7/16* (2006.01)

(52) U.S. Cl. ..... 211/46

(58) Field of Classification Search ..... 211/45, 211/70.6, 94.01, 59.1, 57.1, 46, 124, 89.01; 248/222.11, 222.12, 225.11, 316.7, 74.2; 24/DIG. 53, DIG. 60

See application file for complete search history.

(56) References Cited

U.S. PATENT DOCUMENTS 1,781,991 A * 11/1930 Stover ..... 223/88
3,297,290 A * 1/1967 Patterson ..... 248/222.12
3,515,284 A * 6/1970 Taylor ..... 211/60.1
3,815,756 A * 6/1974 Cox ..... 211/57.1
4,362,285 A * 12/1982 Lewis ..... 248/220.22
4,526,335 A * 7/1985 Garfinkle ..... 248/220.31
4,635,801 A * 1/1987 Oren ..... 211/70.6
4,693,381 A * 9/1987 Lodge ..... 211/94.01
4,749,160 A * 6/1988 Shih ..... 248/316.1
4,826,022 A * 5/1989 Duarte ..... 211/59.1
5,560,574 A * 10/1996 Vanderploeg ..... 248/222.11
5,687,856 A * 11/1997 Kendrena ..... 211/70.6
5,897,002 A * 4/1999 Carlino ..... 211/70.6

* cited by examiner

*Primary Examiner*—Sarah Purol
(74) *Attorney, Agent, or Firm*—Mark M. Friedman

(57) ABSTRACT

Disclosed is a system for holding and organizing articles that provides for easy addition of new holding elements to the system without the need to disturb existing system elements. The system includes holding "clips" that are deployable on the system "rail" by inserting a portion of the clip through a slot in the rail, at substantially any point along the length of the slot. The clip then lockingly engages the rail at substantially any point along the length of the slot.

26 Claims, 7 Drawing Sheets

SYSTEM FOR HOLDING AND ORGANIZING ARTICLES

FIELD AND BACKGROUND OF THE INVENTION

The present invention relates to mechanisms for holding and organizing articles and, in particular, it concerns a system that provides for easy addition of new holding elements to the system with out the need to disturb existing system elements, and further providing for easy adjustment of holding elements within the system.

One embodiment of a device disclosed in U.S. Pat. No. 3,515,284 to Taylor consists of a runner bar and springy clip halves, the clips being held in place by the friction of the spring effect between two legs of the clip base. Each of the clips of Taylor must be inserted into the runner bar at one of the two ends and then slid to the desired location along the length of the runner bar. This may prove to be a cumbersome process if a large number of clips need to be arranged along the length of a loge runner bar. Once a suitable arrangement of clips is deployed, articles may be held in place between two opposing clips. If a new article is to be added to the group of articles stored or held on the assembled device, it may require that some clips be removed from the end of the runner bar, the clips for the new article inserted into the runner bar and the previously removed clips reinserted. One can well imagine the inconvenience of this process if a large number of clips must be removed and reinserted.

One solution to overcome the problem of feed holding elements from an open end of a runner of rail is disclosed in U.S. Pat. No. 4,826,022 to Duarte. The Duarte device includes two panels each of which contain associated slots. One of the slots is configured with notches arranged to engage the engagement portion of the hanger element. Placement of the Duarte hangers is limited by the position of the notches, and therefore placement of the hangers is not continuously variable along the full length of the slot.

Another solution to overcome feeding holding elements from the end of a runner or rail is disclosed in U.S. Pat. No. 4,635,801 to the present inventor. The rails of this device are configured with a longitudinal slot. The holding elements are configured with a holder portion configured to extend perpendicular to the rail, with a gripper portion configured so as to fit through the slot. Once inserted in the slot the gripper is rotated so as to align with the rail along the edge of the slot. By tightening a screw, the gripper than grips the portion of the rail between the gripper and the base of the holder portion. This device suffers from the need to rotate the gripper so as to bring it into suitable alignment with the rail, both during installation of the holding element and when adjusting the position of the holding element on the rail.

There is therefore a need for a holding and storage system that provides easy attachment of holding elements to a base element substantially along the entire length of a slot provided in the base element such that a connecting portion of the holding element may be inserted into the slot at substantially any point along the length of the slot.

SUMMARY OF THE INVENTION

The present invention is a system for holding and organizing articles that provides for easy addition of new holding elements to the system without the need to disturb existing system elements.

According to the teachings of the present invention there is provided, A system for holding and storing articles comprising: (a) a support element configured with at least one slot, the slot being defined by spaced apart substantially parallel edges; and (b) at least one holder element configured with an article support portion and a position-retaining portion, the position-retaining portion configured so as to be elastically deformable between a relaxed state and a compressed state, such that in the compressed state the position-retaining portion is insertable through the slot, upon insertion through the slot, the position-retaining portion is released toward the relaxed state so as to engage the support element, thereby retaining the holder element in position on the support element, the engagement being at substantially any point along the slot.

According to a further teaching of the present invention, the support element is configured as a rail with a constant cross-sectional profile.

According to a further teaching of the present invention, the support element is an extruded rail configured from a material chosen from a list of materials including metals and plastics.

According to a further teaching of the present invention, the holder element is configured such that the article support portion independently supports an article.

According to a further teaching of the present invention, the article support portion is configured as a hook.

According to a further teaching of the present invention, the holder element is configured as at least two associated holder elements arranged to support an article.

According to a further teaching of the present invention, the holder elements are configured such that at least one the article support portion is springy such that, once deployed on the support element, the springiness is in a direction substantially parallel to the slot, whereby an article is supported between the two holder elements by the force of the spring tension of the at least one springy article support portion.

According to a further teaching of the present invention, the position-retaining portion is configured so as to engage the edges of the slot.

According to a further teaching of the present invention, the position-retaining portion is configured so as to grasp a region of each of the edges of the slot between at least two locking members.

According to a further teaching of the present invention, the locking members include gripping edges.

According to a further teaching of the present invention, the position-retaining portion is configured such that the holder element is rotated about an axis substantially perpendicular to a plane defined by the edges of the slot in order to bring the locking members into alignment with the edges so as to allow the grasping.

According to a further teaching of the present invention, the position-retaining portion is brought to the compressed state prior to the rotation.

According to a further teaching of the present invention, the holder element further comprises two notches each located opposite one another on sides of the holder element, each of the notches configured to accept insertion of the regions of the edges of the slot during the rotation, such that release of the position-retaining portion toward the relaxed state causes the grasping.

According to a further teaching of the present invention, the support element further comprises a rearward wall configured with a parallel-sided groove aligned with the slot, the groove configured so as to restrict rotation of the holder element about the axis during the grasping.

There is also provided according to the teachings of the present invention, a system for holding and storing articles comprising: (a) a support element configured with at least one slot, the slot being defined by spaced apart substantially parallel edges; and (b) at least one holder element configured with an article support portion and a position-retaining portion, the position-retaining portion configured so as to be elastically deformable between a relaxed state and a compressed state, such that in the compressed state the position-retaining portion is insertable through the slot, the holder element further configured such that upon insertion through the slot, the holder element is rotated about an axis substantially perpendicular to a plane defined by the edges of the slot, thereupon the position-retaining portion is released toward the relaxed state so as to engage the support element, thereby retaining the holder element in position on the support element, the engagement being at substantially any point along the slot.

According to a further teaching of the present invention, the support element is configured as a rail with a constant cross-sectional profile.

According to a further teaching of the present invention, the support element is an extruded rail configured from a material chosen from a list of materials including metals and plastics.

According to a further teaching of the present invention, the holder element is configured such that the article support portion independently supports an article.

According to a further teaching of the present invention, the article support portion is configured as a hook.

According to a further teaching of the present invention, the holder element is configured as at least two associated holder elements arranged to support an article.

According to a further teaching of the present invention, the holder elements are configured such that at least one the article support portion is springy such that, once deployed on the support element, the springiness is in a direction substantially parallel to the slot, whereby an article is supported between the two holder elements by the force of the spring tension of the at least one springy article support portion.

According to a further teaching of the present invention, the position-retaining portion is configured so as to engage the edges of the slot.

According to a further teaching of the present invention, the position-retaining portion is configured so as to grasp a region of each of the edges of the slot between at least two locking members.

According to a further teaching of the present invention, the locking members include gripping edges.

According to a further teaching of the present invention, the position-retaining portion is configured such that the rotation brings the locking members into alignment with the edges of the slot so as to allow the grasping.

According to a further teaching of the present invention, the holder element further comprises two notches each located opposite one another on sides of the holder element, each of the notches configured to accept insertion of the regions of the edges of the slot during the rotation, such that release of the position-retaining portion toward the relaxed state causes the grasping.

According to a further teaching of the present invention, the support element further comprises a rearward wall configured with a parallel-sided groove aligned with the slot, the groove configured so as to restrict rotation of the holder element about the axis during the grasping.

There is also provided according to the teachings of the present invention, a method for holding and storing articles comprising: (a) providing a support element configured with at least one slot, the slot being defined by spaced apart substantially parallel edges; (b) providing at least one holder element configured with an article support portion and a position-retaining portion, the position-retaining portion configured so as to be elastically deformable between a relaxed state and a compressed state; (c) bring the position-retaining portion to the compressed state; (d) inserting the position-retaining portion through the slot; (e) rotating the holder element about an axis substantially perpendicular to a plane defined by the edges of the slot; (f) engaging the support element by releasing the position-retaining portion toward the relaxed state, thereby retaining the holder element in position on the support element, the engagement being at substantially any point along the slot; and (g) holding an article with at least one holder element.

According to a further teaching of the present invention, the support element is implemented as a rail with a constant cross-sectional profile.

According to a further teaching of the present invention, the support element is implemented as an extruded rail configured from a material chosen from a list of materials including metals and plastics.

According to a further teaching of the present invention, the holding is accomplished by a single holder element.

According to a further teaching of the present invention, the article support portion is implemented as a hook.

According to a further teaching of the present invention, the holding is accomplished using at least two associated holder elements arranged to support an article.

According to a further teaching of the present invention, the holding is accomplished using the at least two holder elements configured such that at least one the article support portion is springy such that, once deployed on the support element, the springiness is in a direction substantially parallel to the slot, whereby an article is supported between the two holder elements by the force of the spring tension of the at least one springy article support portion.

According to a further teaching of the present invention, the engagement is to the edges of the slot.

According to a further teaching of the present invention, the engagement is implemented as grasping a region of each of the edges of the slot between at least two locking members.

According to a further teaching of the present invention, the rotation brings the locking members into alignment with the edges of the slot so as to allow the grasping.

According to a further teaching of the present invention, the alignment further comprises two notches each located opposite one another on sides of the holder element, each of the notches configured to accept insertion of the regions of the edges of the slot during the rotation, such that release of the position-retaining portion toward the relaxed state causes the grasping.

According to a further teaching of the present invention, there is also provided, providing the support element configured with a rearward wall, the rearward wall configured with a parallel-sided groove aligned with the slot, the groove configured so as to restrict rotation of the holder element about the axis during the grasping.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a system for holding and organizing articles that provides for easy addition of new holding elements to the system without the need to disturb existing system elements.

The principles and operation of a system for holding and organizing articles that provides for easy addition of new holding elements to the system without the need to disturb existing system elements according to the present invention may be better understood with reference to the drawings and the accompanying description.

By way of introduction, the device of the present invention consists of a support element 2, hereafter referred to as the "rail" 2 for brevity, to which are attached at least one holder element 30, hereafter referred to as a "clip" 30 for brevity. A principle of the present invention is to provide a rail that includes a slot with substantially parallel edges. It is another principle of the present invention to provide a clip that is deployable on the rail by inserting the position-retaining portion of the clip through the slot, at substantially any point along the length of the slot, the clip is further configured so as to engage the rail at substantially any point along the length of the slot. While the embodiment of the rail herein described is a one-piece extruded rail configured preferably from metal, however the use of plastic is within the scope of the present invention. It will be readily apparent to one of ordinary skill in the art that the forward and rearward walls of the rail need not be configured as parts of an integral unit, as herein described, but rather may be separate associated pieces that perform the same function. It will be further apparent that the forward and rearward walls may be configured as associated panels, the forward panel may include a plurality of slots, and that the slots may be disposed at any given angle. The forward wall may also be formed from separated pieces that are spaced apart so as to form a slot between them. Alternatively, the slot may be provided in a single walled rail.

Figure 1:
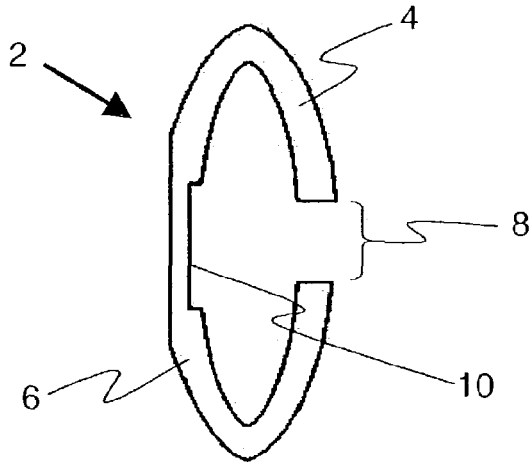
FIG. 1 is a side elevation of an embodiment of a rail constructed and operative according to the teachings of the present invention.
Figure 2:
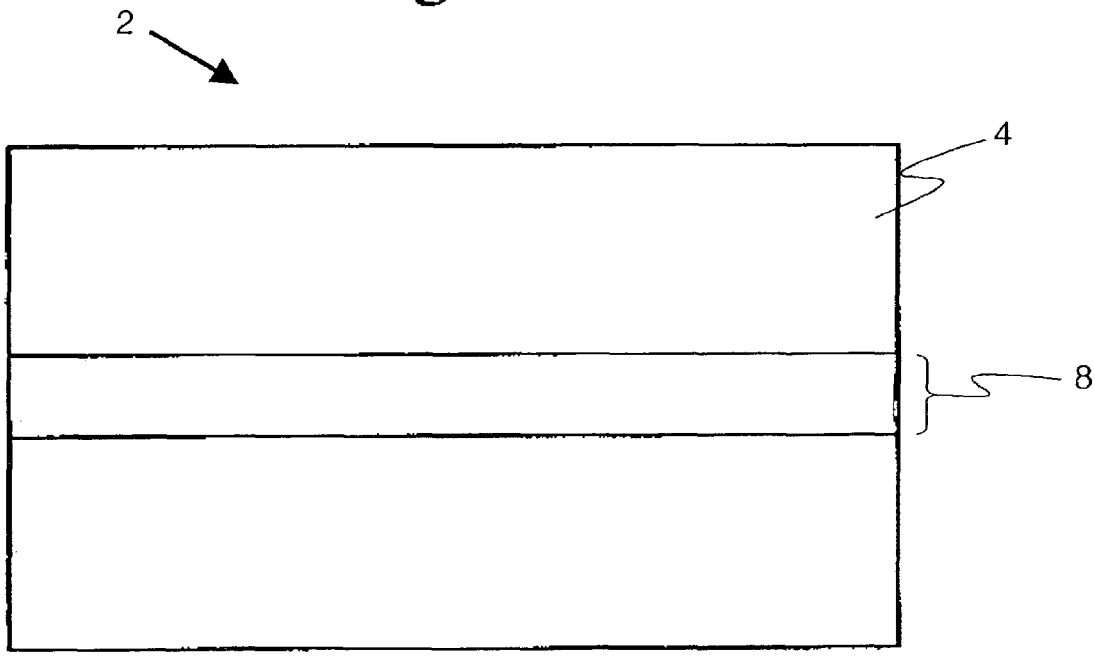
FIG. 2 is a front elevation of the rail of FIG. 1.
Figure 3:
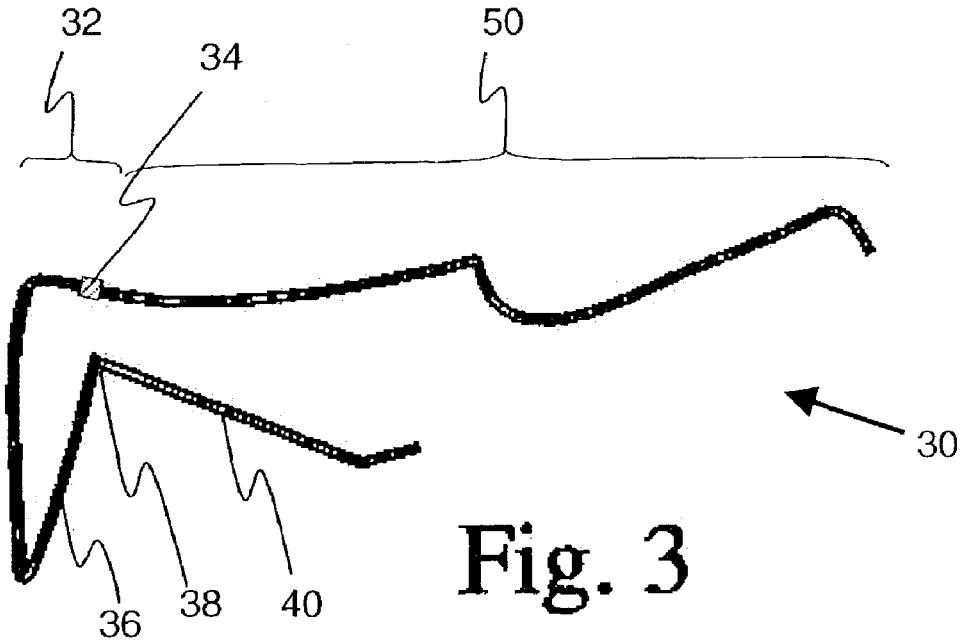
FIG. 3 is a top elevation of a first preferred embodiment of a clip constructed and operative according to the teachings of the present invention, this embodiment being configured to springingly hold an article between two opposing such clips, the clip is shown here with the spring element of the position-retaining portion in a non-compressed state.
Figure 4:
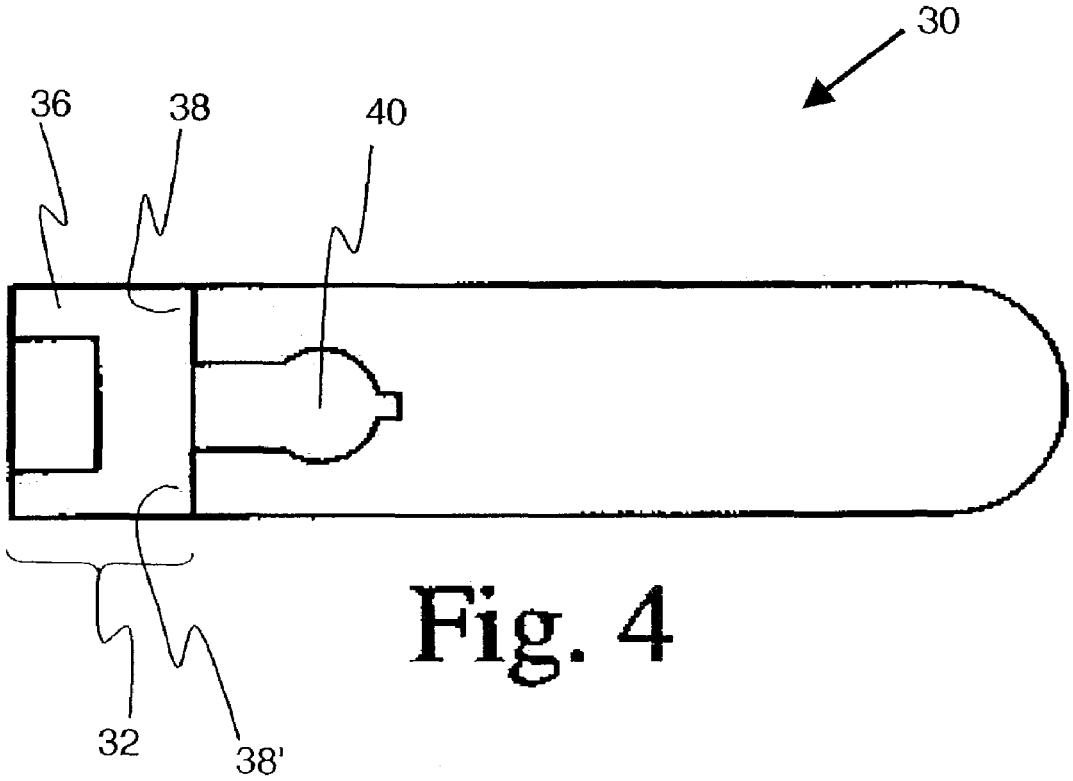
FIG. 4 is a side elevation of the clip of FIG. 3.

Referring now to the drawings, FIGS. 1 and 2 illustrate a preferred embodiment of a rail 2 constructed and operative according to the teachings of the present invention. The substantially parallel-sided slot 8 is configured in the forward wall 4 of the rail 2. Optionally, the rearward wall 6 may be configured with a parallel-sided groove 10 aligned with the slot 8. The groove 10 acts to stabilized the clip 30 when the clip 30 is deployed of the rail 2 (see FIG. 11). In an embodiment in which the forward and rearward walls are configured as panels and the forward wall is configured with a plurality of slots, the rearward wall may be configured with a corresponding number of grooves each aligned with a corresponding slot.

FIGS. 3–6 are illustrative of a spring embodiment of a clip 30 constructed and operative according to the teachings of the present invention. The clip 30 includes a position-retaining portion 32 and an article holding portion 50. It should be noted that while the clip 30 described herein is a single integral unit, this is not intended as a limitation, but rather as a non-limiting example.

Figure 5:
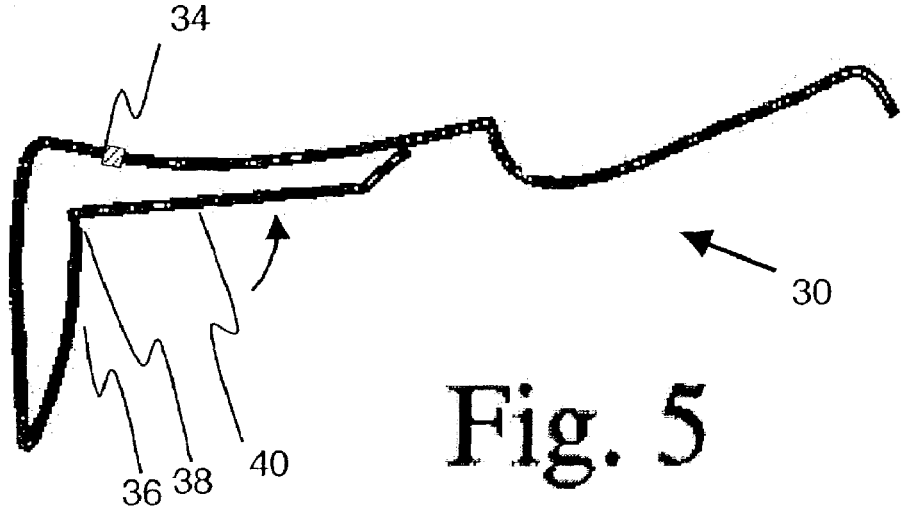
FIG. 5 is a top elevation of the clip of FIG. 3 shown here with the spring element of the position-retaining portion in a compressed state.
Figure 6:
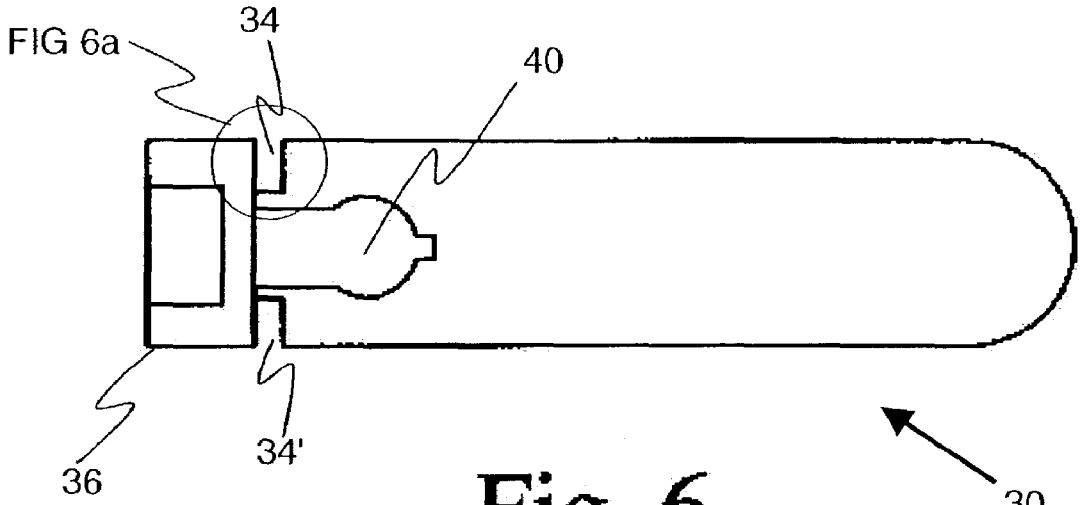
FIG. 6 is a side elevation of the clip of FIG. 5.
Figure 6A:
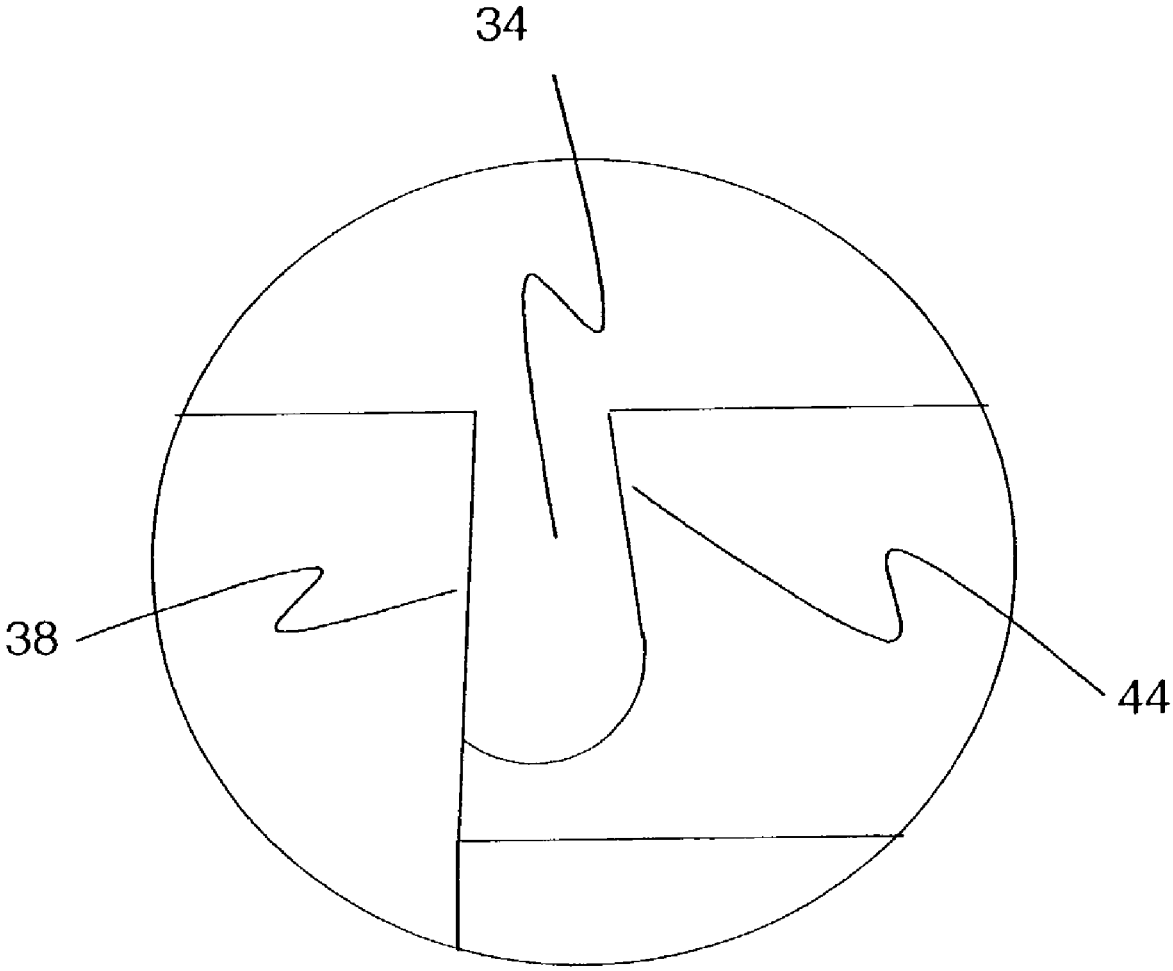
FIG. 6*a* is a detail of FIG. 6.
Figure 10:
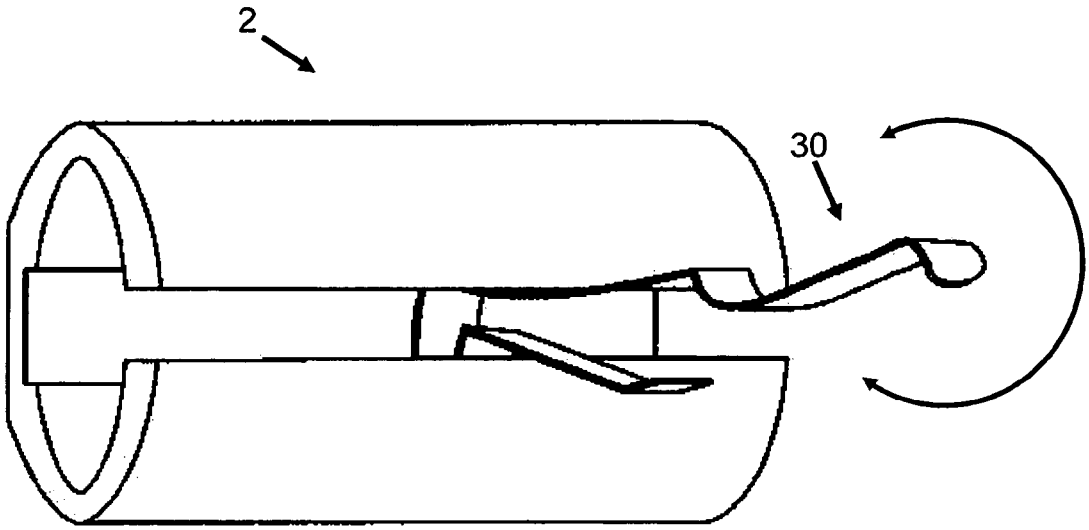
FIG. 10 is an isometric view of step 2 of the deployment process of the clip of FIG. 3 on the rail of FIG. 1.
Figure 11:
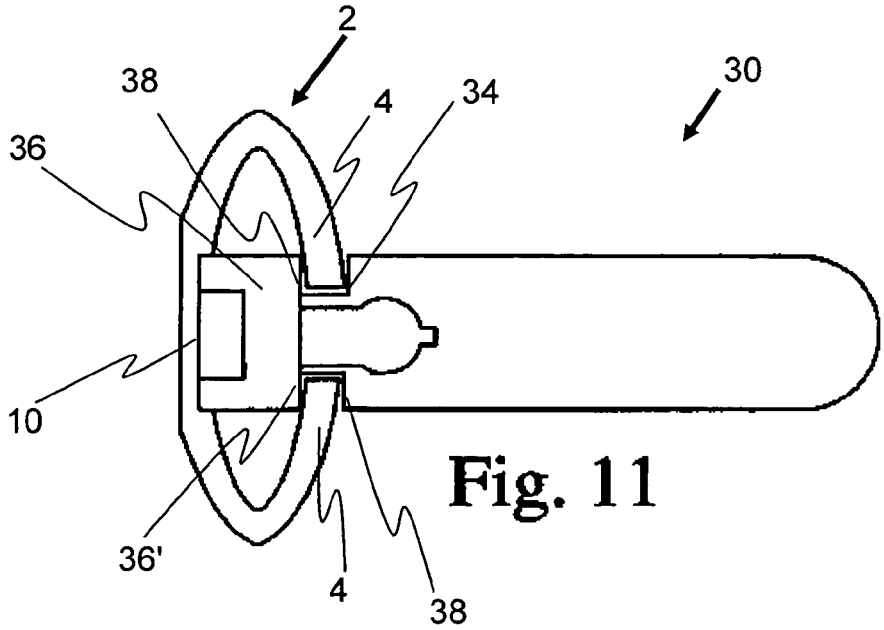
FIG. 11 is a side elevation of step 3 of the deployment process of the clip of FIG. 3 on the rail of FIG. 1.

The position-retaining portion 32 of the clip 30 includes two notches 34 and 34' each located opposite the other on the sides of the clip 30. The two notches 34 and 34' are configured to accept insertion of a portion of the forward wall 4 of the rail 2 when the clip 30 is rotated (FIG. 10) into an article holding deployment as illustrated in FIG. 11. The position-retaining portion 32 further includes a spring element 36 with a locking engagement regions 38 and 38'. In a preferred embodiment of the present invention, as detailed in FIG. 6*a*, the sides 44 of the notches 34 and 34' are angled inwardly, thereby forming a first gripping edge 46 and 46' (not shown). Further, the edge of the locking engagement regions 38 and 38' are configured at an angle, thereby forming a second gripping edge 48 and 48' (not shown). For operation of the spring element 36 an unlocking pad 40 is provided. When the spring tension of the clip 30 is at rest, as in FIG. 3, the two notches 34 and 34' are not accessible from the side of the clip 30 on which the position-retaining portion 32 is configured. As illustrated in FIG. 5, when the unlocking pad 40 is displaced toward the article holding portion 50 of the clip 30, especially when the clip 30 is held between the thumb and forefinger of the user, the notches 34 and 34' are exposed on both sides of the clip 30. Thus, compression of the unlocking pad 40 brings the position-retaining portion 32 into an unlocked state.

Figure 8:
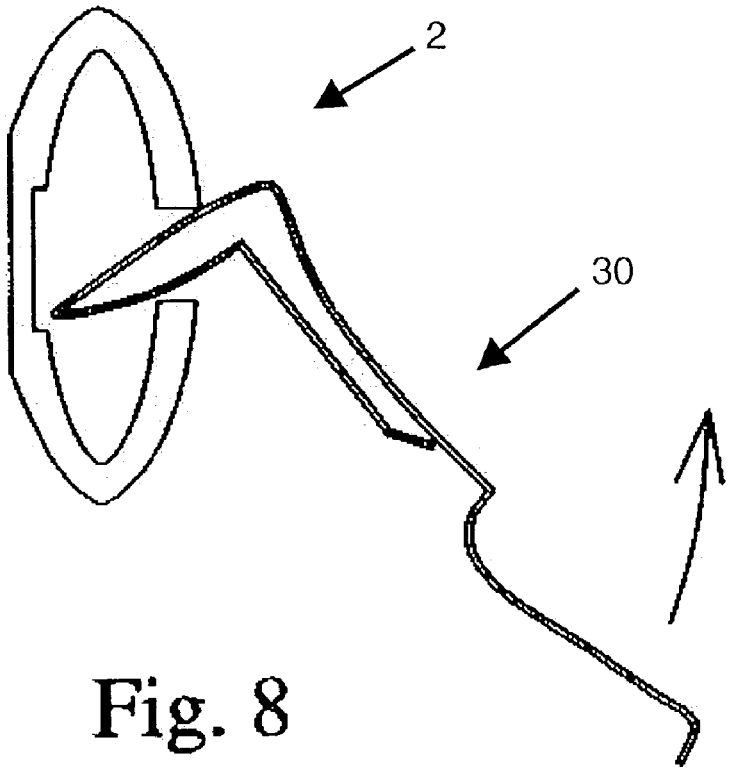
FIGS. 8 and 9 are side elevations of step 1 of the deployment process of the clip of FIG. 3 on the rail of FIG. 1.
Figure 9:
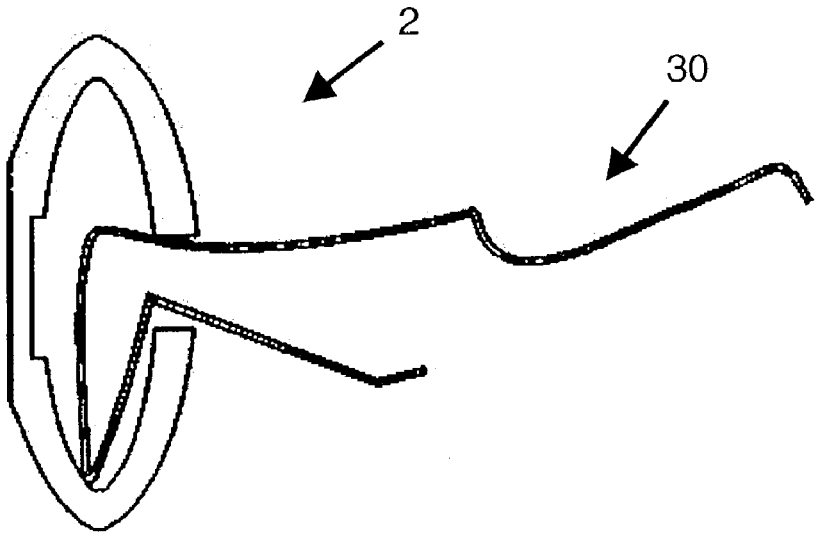

As illustrated in FIGS. 8–11, the steps of deployment of the clip 30 on the rail 2 is effected as follows:

1—The position-retaining portion 32 of the clip 30 is inserted through the slot 8 in the forward wall 4 of the rail 2. This step may include the upward rotation of the clip 30, as shown in FIGS. 8 and 9, in order to complete the insertion. Optionally, it may be necessary to bring the position-retaining portion 32 into an unlocked state in order to be inserted through the slot 8.

Figure 7:
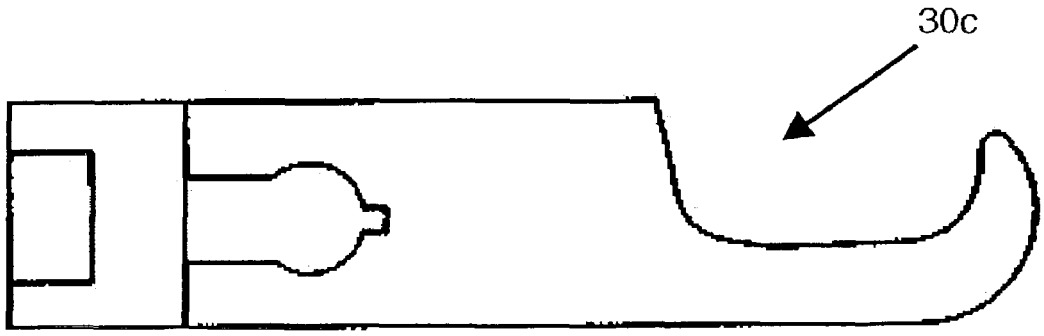
FIG. 7 is a side elevation of a second preferred embodiment of a clip constructed and operative according to the teachings of the present invention, this embodiment configured with a hook.
Figure 12:
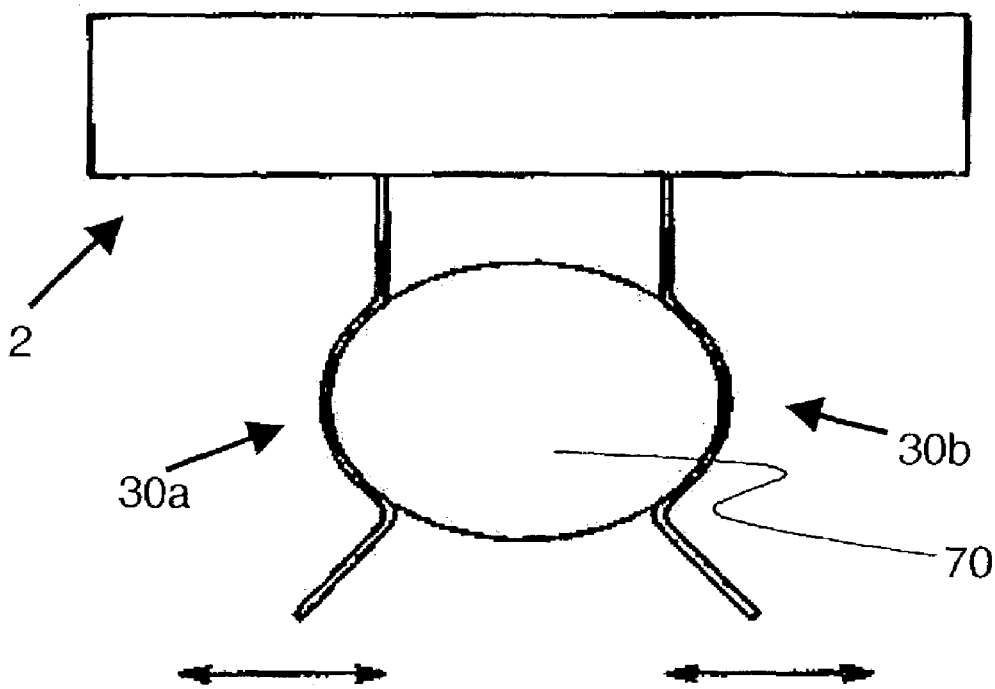
FIG. 12 is a top elevation of two clips of FIG. 3 opposedly deployed on the rail of FIG. 1 so as to support an article between them.
Figure 13:
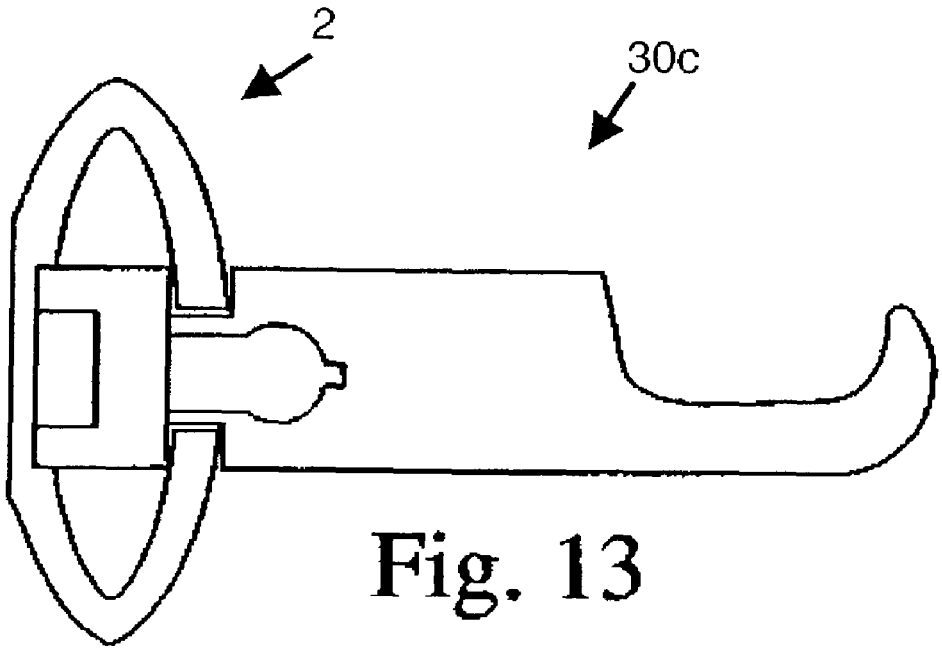
FIG. 13 is a side elevation of a clip of FIG. 7 deployed on the rail of FIG. 1.

2—Once the position-retaining portion 32 of the clip 30 is inserted through the slot 8, the clip 30 is rotated, in this embodiment and for purposes of non-limiting example, approximately 90 degrees such that regions of the edges of the forward wall 4 adjacent to, and above and below, the slot 8 are deployed within the two notches 34 and 34'. The direction of rotation may be either clockwise or counterclockwise depending on the style of the clip 30 being deployed and the direction in which the particular clip must be deployed in order to meet the end use requirements of the user. That is, if two similar spring clips 30*a* and 30*b* are being deployed so as to springly hold an article 70 between them, as in FIG. 12, clip 30*a* is rotated counterclockwise and clip 30*b* is rotated clockwise. If a hook style clip 30*c*, as illustrated in FIG. 7, is being deployed, the clip is rotated in the direction that brings the hook into a proper use deployment. The non-limiting example of a hook style clip 30*c* is rotated counterclockwise to achieve a proper use deployment, as illustrated in FIG. 13. It will be apparent to one of ordinary skill in the art that the range of sizes and styles of the article holding portion 50 of the clip 30 of the present invention is virtually limitless, therefore, the clips herein described are intended as non-limiting examples only.

3—After the clip 30 is rotated, the unlocking pad 40 is released and, as illustrated in FIG. 11, the regions of the forward wall that are now deployed within the notches 24 and 34' are compressed between the wall of each of the notches 34 and 34' and the corresponding locking engagement regions 38 and 38'. Further, the pressure of the spring tension forces the position-retaining portion 32 against the rearward wall 6 of the rail 2

To effect a change of clip position, the unlocking pad 40 is compressed and the clip 30 may be slid along the rail 2 in either direction to the desired location.

To remove a clip 30 from the rail 2, the steps of deployment are simply reversed. That is, the unlocking pad 40 is compressed, the clip 30 is rotated and the position-retaining portion 32 of the clip 30 is removed through the slot 8.

Some of the advantages of the present invention with regard to the addition of new clips 30 to the rail 2, especially at points along a relatively full rail to which a new storage location is desired near the middle, will be readily apparent to any one who has faced this situation.

It will be appreciated that the above descriptions are intended only to serve as examples, and that many other embodiments are possible within the spirit and the scope of the present invention.

What is claimed is:

1. A system for holding and storing articles comprising:

a) a support element configured with at least one slot, said slot being defined by spaced apart substantially parallel edges; and b) at least one holder element configured with an article support portion, two notches each located opposite one another on sides of said holder element, each of said notches configured to accept insertion of regions of said edges of said slot and a position-retaining portion, said position-retaining portion configured so as to be elastically deformable between a relaxed state and a compressed state, such that in said compressed state said position-retaining portion is insertable through said slot, upon insertion through said slot, said position-retaining portion is released toward said relaxed state so as to engage said edges of said slot, thereby retaining said holder element in position on said support element, said engagement being at substantially any point along said slot;

wherein said position-retaining portion is configured so as to grasp said region of each of said edges of said slot between at least two locking members, and said position-retaining portion is configured such that said holder element is rotated about an axis substantially perpendicular to a plane defined by said edges of said slot in order to bring said locking members into alignment with said edges so as to allow said grasping, and said position-retaining portion is brought to said compressed state prior to said rotation, and each of said notches is configured to accept insertion of said regions of said edges of said slot during said rotation, such that release of said position-retaining portion toward said relaxed state causes said grasping.

2. The system of claim 1, wherein said support element is configured as a rail with a constant cross-sectional profile.

3. The system of claim 2, wherein said support element is an extruded rail configured from a material chosen from a list of materials including metals and plastics.

4. The system of claim 1, wherein said holder element is configured such that said article support portion independently supports an article.

5. The system of claim 4, wherein said article support portion is configured as a hook.

6. The system of claim 1, wherein said holder element is configured as at least two associated holder elements arranged to support an article.

7. The system of claim 6, wherein said holder elements are configured such that at least one said article support portion is springy such that, once deployed on said support element, said springiness is in a direction substantially parallel to said slot, whereby an article is supported between said two holder elements by the force of the spring tension of said at least one springy article support portion.

8. The system of claim 1, wherein said locking members include gripping edges.

9. The system of claim 1, wherein said support element further comprises a rearward wall configured with a parallel-sided groove aligned with said slot, said groove configured so as to restrict rotation of said holder element about said axis during said grasping.

10. A system for holding and storing articles comprising:

a) a support element configured with at least one slot, said slot being defined by spaced apart substantially parallel edges; and b) at least one holder element configured with an article support portion, two notches each located opposite one another on sides of said holder element each of said notches configured to accept insertion of regions of said edges of said slot and a position-retaining portion, said position-retaining portion configured so as to be elastically deformable between a relaxed state and a compressed state, such that in said compressed state said position-retaining portion is insertable through said slot, said holder element further configured such that upon insertion through said slot, said holder element is rotated about an axis substantially perpendicular to a plane defined by said edges of said slot, thereupon said position-retaining portion is released toward said relaxed state so as to engage said support element, thereby retaining said holder element in position on said support element, said engagement being at substantially any point along said slot;

wherein said position-retaining portion is configured so as to engage said edges of said slot, by grasping said region of each of said edges of said slot between at least two locking members, such that said rotation brings said locking members into alignment with said edges of said slot so as to allow said grasping, and each of said notches is configured to accept insertion of said regions of said edges of said slot during said rotation, such that release of said position-retaining portion toward said relaxed state causes said grasping.

11. The system of claim 10, wherein said support element is configured as a rail with a constant cross-sectional profile.

12. The system of claim 11, wherein said support element is an extruded rail configured from a material chosen from a list of materials including metals and plastics.

13. The system of claim 10, wherein said holder element is configured such that said article support portion independently supports an article.

14. The system of claim 13, wherein said article support portion is configured as a hook.

15. The system of claim 10, wherein said holder element is configured as at least two associated holder elements arranged to support an article.

16. The system of claim 15, wherein said holder elements are configured such that at least one said article support portion is springy such that, once deployed on said support element, said springiness is in a direction substantially parallel to said slot, whereby an article is supported between said two holder elements by the force of the spring tension of said at least one springy article support portion.

17. The system of claim 10, wherein said locking members include gripping edges.

18. The system of claim 10, wherein said support element further comprises a rearward wall configured with a parallel-sided groove aligned with said slot, said groove configured so as to restrict rotation of said holder element about said axis during said grasping.

19. A method for holding and storing articles comprising:

a) providing a support element configured with at least one slot, said slot being defined by spaced apart substantially parallel edges;

b) providing at least one holder element configured with an article support portion, two notches each located opposite one another on sides of said holder element, each of said notches configured to accept insertion of regions of said edges of said slot and a position-retaining portion, said position-retaining portion configured so as to be elastically deformable between a relaxed state and a compressed state;

c) bring said position-retaining portion to said compressed state;

d) inserting said position-retaining portion through said slot;

e) rotating said holder element about an axis substantially perpendicular to a plane defined by said edges of said slot;

f) grasping a region of each of said edges of said slot between at least two locking members by releasing said position-retaining portion toward said relaxed state, thereby retaining said holder element in position on said support element, said engagement being at substantially any point along said slot; and g) holding an article with at least one holder element;

wherein said rotation brings said locking members into alignment with said edges of said slot so as to allow said grasping, and each of said notches accepts insertion of said regions of said edges of said slot during said rotation such that release of said position-retaining portion toward said relaxed state causes said grasping.

20. The method of claim 19, wherein said support element is implemented as a rail with a constant cross-sectional profile.

21. The method of claim 20, wherein said support element is implemented as an extruded rail configured from a material chosen from a list of materials including metals and plastics.

22. The method of claim 19, wherein said holding is accomplished by a single holder element.

23. The method of claim 22, wherein said article support portion is implemented as a hook.

24. The method of claim 19, wherein said holding is accomplished using at least two associated holder elements arranged to support an article.

25. The method of claim 23, wherein said holding is accomplished using said at least two holder elements configured such that at least one said article support portion is springy such that, once deployed on said support element, said springiness is in a direction substantially parallel to said slot, whereby an article is supported between said two holder elements by the force of the spring tension of said at least one springy article support portion.

26. The method of claim 19, further comprises providing said support element configured with a rearward wall, said rearward wall configured with a parallel-sided groove aligned with said slot, said groove configured so as to restrict rotation of said holder element about said axis during said grasping.

* * * * *